United States Patent [19]

Morton

[11] 4,055,871

[45] Nov. 1, 1977

[54] SILENCER DEVICE

[76] Inventor: John T. Morton, 15-2nd St., c/o P.O. Box 231, Scotstown, Quebec, Canada, J0B 3B0

[21] Appl. No.: 721,392

[22] Filed: Sept. 8, 1976

[51] Int. Cl.[2] ..... E05D 13/00; E05D 15/00

[52] U.S. Cl. ..... 16/86 A

[58] Field of Search ..... 16/85, 82, 86; 109/63.5; 292/341.12

[56] References Cited

U.S. PATENT DOCUMENTS

| | | | |
|---|---|---|---|
| 1,599,976 | 9/1926 | Piper et al. | 16/86 |
| 1,742,483 | 1/1930 | Moody | 16/85 |
| 1,816,024 | 7/1931 | Petersen | 16/85 |
| 1,828,431 | 10/1931 | Nelson | 16/86 A |
| 1,835,775 | 12/1931 | Hay | 16/86 A |
| 2,517,966 | 8/1950 | Boye | 16/86 A |
| 2,526,467 | 10/1950 | Fry | 16/86 |
| 2,639,461 | 5/1953 | Fry | 16/86 A |
| 2,784,443 | 3/1957 | Berg | 16/85 |

*Primary Examiner*—Ronald Feldbaum
*Attorney, Agent, or Firm*—Allen D. Brufsky

[57] ABSTRACT

A silencer device for a door or a window includes a P-shaped element having a head portion with an opening therethrough and a tail portion having a plurality of longitudinally aligned apertures therethrough. The tail portion is mounted onto the door jamb by screws extending through the apertures, wherein the head portion extends forwardly of the door jamb.

4 Claims, 5 Drawing Figures

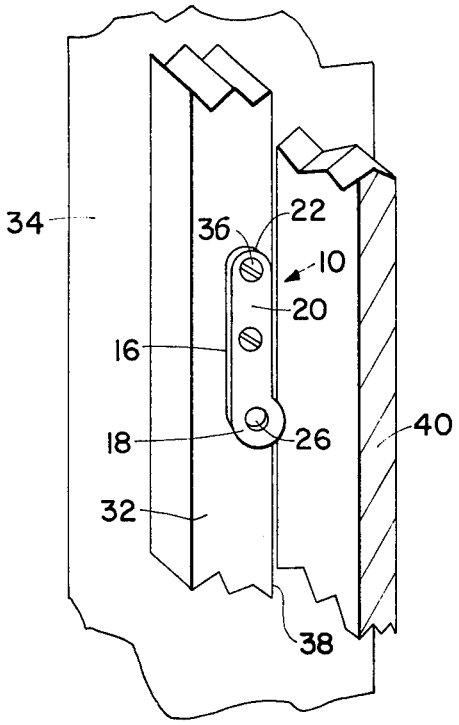
FIG. 1
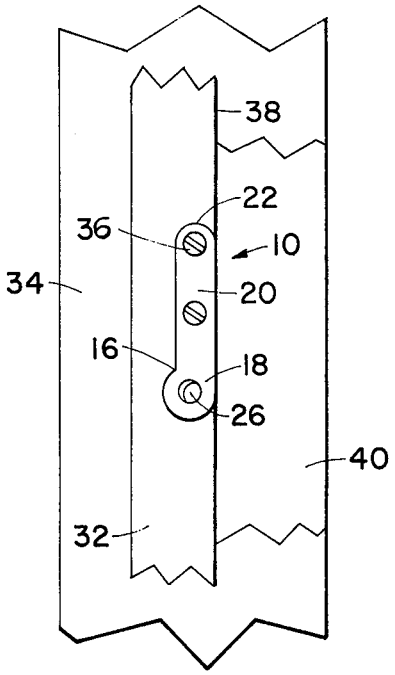
FIG. 2
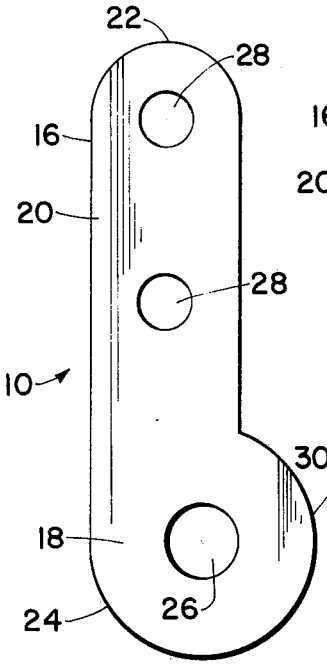
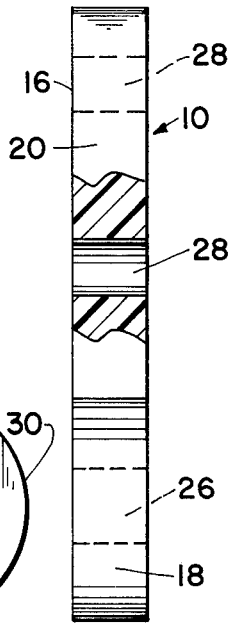
FIG. 3 FIG.5
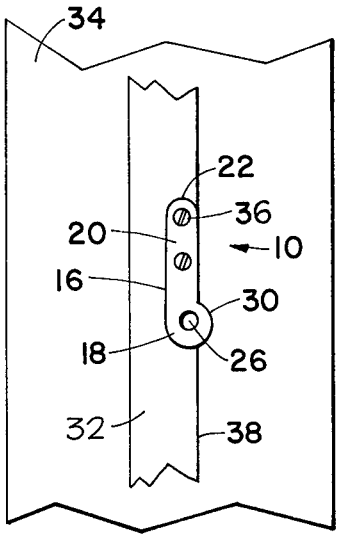
FIG. 4

SILENCER DEVICE

BACKGROUND OF THE INVENTION

A number of United States Patents relate to door stop means for the preventation of slamming of doors, but these devices are non-applicable to the simple design of my present instant invention. These U.S. Pat. Nos. are; 2,119,143 to Tringale; 2,480,701 to Bradbury; 2,517,966 to Boye; and 2,639,461 to Fry.

SUMMARY OF THE INVENTION

My present invention relates to a silencer device called "Silent Sam:" for eliminating slamming of a door thereby preventing damage to the door, door lock, catches and breakage to glass and door hinges; and for preventing the sudden sliding down of windows thereby preventing breakage to the glass as well as rattling of the windows, when in the closed position.

An object of my present invention is to provide a silencer device of simple design which can prevent the slamming of the door or the rattling of the windows.

Briefly, my present invention comprises a P-shaped element having a head portion with an opening therethrough and a tail portion having a plurality of longitudinally aligned apertures therethrough. The tail portion is mounted onto the door jamb by screws extending through the apertures, wherein the head portion extends forwardly of the door jamb.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a side perspective view of a silencer device mounted on a door jamb with the door opened;

FIG. 2 illustrates a side perspective view of the silencer device with the door closed upon the silencer device;

FIG. 3 illustrates a front planar view of the silencer device;

FIG. 4 illustrates a front enlarged planar view of the silencer device mounted on the door jamb; and FIG. 5 illustrates a side cross sectional view of the silencer device.

DESCRIPTION OF THE PREFERRED EMBODIMENT

Turning now descriptively to the drawings, in which similar reference characters denote similar elements throughout the several views, FIGS. 1 thru 4 show a silencer device 10 adapted to mounted on a door jamb 32 to prevent slamming of a door 40 or on a vertical window guide strip to prevent rattling of the window. The device 10 comprises a flexible thermoplastic element 16 of a generally P-shaped configuration having a circularly shaped head portion 18 and a rectangularly shaped tail portion 20, wherein the free outer end 22 of portion 20 has a smooth curved surface. The upper left hand corner 24 of the P-shaped element 16 has a smooth curved surface. The center of the head portion 18 has an enlarged opening 26 therethrough. The tail portion 20 has a plurality of longitudinally aligned apertures therethrough. The enlarged opening 26 in the head portion 18 imparts flexibility to the P-shaped element 16, when a transverse impact force is applied to the outer right hand curved edge 30 of the head portion 18 of the P-shaped element 16.

In use, as shown in FIGS. 1 and 2, the tail portion 20 of the P-shaped element 16 is affixed onto the vertical door jamb 32 of a door frame 34, by screw means 36 extending through apertures 28 into the door jamb 32, wherein the outer edge 30 of the head portion 18 of element 16 extends forwardly of the forward edge 38 of the door jamb 32. When the door 40 is closed the door 40 engages the outer edge 30 of the head portion 18 of element 16 causing the head portion 18 to move rearwardly until the door 40 engages the forward edge 38 of the door jamb 32 as the head portion 18 of element 16 retracts behind the forward edge 38 of the door jamb 32. When the element 16 is mounted by screw means 36 to the guide strip of a window frame, the outer edge 30 of the head portion 18 of the element 16 engages against the forward vertical face of the vertical side of the window.

Some of the thermoplastic materials found suitable in the manufacture of the element 16 are selected from the group consisting of low density polyethylene, polyethylene vinyl acetate, polypropylene, nylon, or polyester.

The dimensions of the element 16 which creates maximum shock absorbing means are radius of head portion being 0.375 inches; width of tail portion being 0.500 inches; length of element being 2.000 inches; thickness of element 16 being 0.375 inches; and diameter of apertures 28 and hole 26 being 0.1875 inches.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A silencer device for prevention of slamming of a door, which comprises a P-shaped element having a head portion and a tail portion, a bottom end of said tail portion being curved, said tail portion having a plurality of longitudinally aligned apertures therethrough; a upper left hand corner of said P-shaped element being curved, said tail portion of said P-shaped element adapted to be removabably mounted on a vertical door jamb of a door frame by screw means extending through said aperture into said door jamb, said head portion of said P-shaped element extending forwardly of a forward edge of said door jamb and adapted to receive said door thereupon.

2. A device according to claim 1, wherein said P-shaped element is formed from a flexible thermoplastic thereby allowing said head portion to be deformed rearwardly upon closing said door upon said head portion.

3. A device according to claim 2, wherein said P-shaped element has a shock absorbing means disposed therein.

4. A device according to claim 3, wherein said shock absorbing is an opening extending through said head portion.

* * * * *